United States Patent [19]

Farquharson

[11] Patent Number: 4,671,427

[45] Date of Patent: Jun. 9, 1987

[54] MILK BAG PITCHER

[76] Inventor: Charles R. Farquharson, 696 Durie St., Toronto, Ontario, Canada, M6S 3H3

[21] Appl. No.: 851,155

[22] Filed: Apr. 14, 1986

[51] Int. Cl.[4] ..... B67B 7/24

[52] U.S. Cl. ..... 222/83.5; 222/502; 222/505; 24/30.5 R; 30/124

[58] Field of Search ..... 222/80–81, 222/83, 83.5, 88, 92, 105, 183, 465 R, 502–503, 541, 544, 561, 505; 24/30.5 R, 30.5 L, 490; 30/123, 124

[56] References Cited

U.S. PATENT DOCUMENTS

| | | | |
|---|---|---|---|
| 348,873 | 9/1886 | Wales | 24/490 |
| 2,872,081 | 2/1959 | Randall | 222/183 |
| 3,606,962 | 9/1971 | Scholle | 222/105 |
| 3,799,400 | 3/1974 | Fleury | 222/83.5 |
| 3,809,290 | 5/1974 | Schmit | 222/88 |
| 3,871,559 | 3/1975 | Smith et al. | 222/183 |
| 3,908,864 | 9/1975 | Kapper | 222/105 |
| 3,940,018 | 2/1976 | Scholle | 222/1 |
| 3,974,942 | 8/1976 | Gray et al. | 222/83.5 |
| 4,580,342 | 4/1986 | Beuzart | 30/2 |

FOREIGN PATENT DOCUMENTS

| | | | |
|---|---|---|---|
| 130165 | 1/1985 | European Pat. Off. | 24/490 |

*Primary Examiner*—Joseph J. Rolla

*Assistant Examiner*—Michael S. Huppert

*Attorney, Agent, or Firm*—Donald F. Hewson

[57] ABSTRACT

A covered pitcher for form-filled flexible plastic bags is provided. The flexible plastic bag is normally filled with a potable liquid such as milk, but fruit juices or wine may also be possible. The pitcher has a bottom portion of dimensions so as to substantially accommodate the flexible plastic bag when filled and sealed. The cover fits the bottom in co-operating manner. An opening is formed in the front upper corner of the cover, and the opening has a cutter head mounted therein for upward and downward movement within the opening. The cutter head is associated with a pair of curved and rockable arms which have closer faces that are curved away from each other at least in the upper portions thereof, and are mounted so as to be in close proximity to each other in the lower portions and over a substantial portion of the length of each closer face when the cutter head is moved to the lower end of the opening. A cutting edge is carried by the cutter head. When the bag is first placed in the pitcher, the cutter head is moved downwardly so as to cut off the front upper corner of the bag from which the potable liquid may then be dispensed; thereafter, when the cutter head is moved downwardly in the opening the bag is substantially sealed by the material of the bag immediately below the cut corner being captured between the closer faces.

7 Claims, 8 Drawing Figures

MILK BAG PITCHER

FIELD OF THE INVENTION

This invention relates to pitchers, and more particularly to a recloseable pitcher for use in association with flexible plastic bags in which such liquids as milk may be sold, stored, and dispensed from. Moreover, this invention relates to such pitchers wherein the flexible plastic bag placed within the pitcher, once it is opened by removal of a corner therefrom, may be closed.

BACKGROUND OF THE INVENTION

Over the years, the manner of selling, storing, and dispensing such staple commodities as milk, has altered very dramatically. Glass bottles have given way to plastic jugs and paper cartons; and form-filled flexible plastic bags are now becoming more and more widely used. Of course, it has been known for some time for milk (and such other consumable liquid products such as wine) to be sold for storage in flexible plastic bags, but those bags have capacities of anywhere from 4 liters to 40 liters or more. With the possible exception of 4 liter dispensers of wine, such sales of potable liquids in flexible plastic bags are to the commercial or industrial markets—i.e., restaurants, hospitals, school cafeterias, and the like. Milk, on the other hand, is being sold in continually greater quantities, and in ever increasing market areas, in flexible plastic bags generally having a capacity of 1.33 liters, 1.5 U.S. quarts or 1 Imperial quart; where three or four such form-filled plastic bags of milk are, themselves, packaged in an over wrapping or bag for sale. Obviously, every such bag is substantially totally filled, having no void areas; and since each is flexible, it is incapable of being dispensed from except when secured in another dispensing container. If, for example, a fully filled flexible plastic bag of milk were to be opened such as by cutting off a corner thereof, it would be nearly impossible to controllably dispense milk from the bag if it were being held in the hand, unless the opening through which the milk will be dispensed is very small.

Since the time that 1.5 quart or 1.33 liter flexible plastic bags of milk have been introduced into the market, pitchers have also been introduced into the market, generally comprising simply a pitcher or jug whose dimensions approximated those of the bag itself. As an example, a typical pitcher or jug for flexible plastic milk bags is simply an open pitcher or jug of approximately seven inches to eight inches in height, three inches in width, and five inches from front to back. In order to store and dispense milk using flexible bags and such pitchers, it has appeared simply to be necessary to place the flexible plastic bag of milk into the pitcher, cut off the front corner thereof using a knife or a pair of scissors, and tip the pitcher with the milk bag in it so as to dispense milk therefrom. This, however, has over the years proven to be unsatisfactory, for at least the following reasons: First, dimensions of flexible plastic bags in which milk has been sold may vary so that if the bag is too high, it may tend at least in the beginning to "flop" forward and thereby given an uncontrolled flow from the cut corner. Also, as milk is dispensed from time to time from the bag, unless the bag collapses relatively evenly, it is still possible for there to be uncontrolled flow from the bag. A principal concern and cause for complaint, however, has been that once the flexible plastic bag has been opened, there has been no easy or practical way of closing it once again; many users have resorted to such means as spring loaded clothes pins, paper clips, and the like, so as to try to keep the milk in an opened flexible bag from spoiling and/or absorbing refrigerator odors.

A recent product that has entered the market is one sold by Totson Products Inc. of Willowdale, Ontario, Canada, having a slide-on lid. This product—in respect of which patents are said to be pending—is one which has a pitcher having the general dimensions of a flexible plastic bag of milk, into which a bag of milk is inserted; and a lid that is slid onto the pitcher from the back side thereof, and engages shoulders at the sides thereof by inturned lips beneath the side edges of the lid. The engagement of the lid to the pitcher is such that the top of the plastic bag is slightly forwardly pushed, so that (hopefully) the front corner of the bag protrudes from an opening which is formed in the pitcher and between the pitcher and the lid, at the front upper corner thereof. Thereafter, a pair of scissors is used to cut the protruding corner by snipping it in a side-to-side manner, so that milk may be dispensed from the pitcher. However, once the bag has been cut, it is not possible to close it; and the fact that the corner of the bag more or less fills the opening at the upper front corner of the pitcher, and is confined by the lid or cover thereof, makes it substantially impossible even to attempt to close the bag such as by placing a clothes pin over the edges of the cut corner.

Other patent structures that have been noted, in respect of which milk is stored in a flexible plastic bag, are all of the kind that is used for restaurant or the like purposes. For example, Scholle, et al U.S. Pat. No. 3,940,018 issued Feb. 24, 1976, teach a combined container and dispenser where a reuseable, rigid case may have a flexible plastic bag filled with the milk or other liquids placed therein. However, the bag has a dispensing tube such that the liquid may be dispensed by gravity from the bottom of the bag, the whole case being such that it will fit into a standard bulk milk dispensing cabinet.

A generally similar container for plastic bags having dispensing tubes, for use in bulk dispensing cabinets or machines, is taught by Kapper in U.S. Pat. No. 3,908,864 issued Sept. 30, 1975.

Yet another patent, also relating to a container for a flexible bag of milk having a dispensing tube, this time having a removable front wall which is transparent, is taught in Smith et al. U.S. Pat. No. 3,871,559 issued Mar. 18, 1975.

The present invention, on the other hand, is directed to a covered pitcher in which flexible plastic bags filled with milk or other potable liquids may be placed; but unlike any prior art or commercially available products, the present invention specifically provides means whereby the upper front corner of the flexible plastic bag may be cut from the bag, and moreover that the open corner may be closed and opened so as to permit dispensing of the liquid when desired.

In general terms, the present invention provides a pitcher whose dimensions accommodate a flexible plastic bag, where the volume of the pitcher-like bottom portion of the structure of the present invention approximates that of the volume of an unopened flexible bag of liquid such as milk. A substantially rigid top portion is adapted to fit to the pitcher like bottom portion, so as to provide a cover therefore; and, of course, a handle is associated with the back face of the bottom portion so as to facilitate lifting, carrying, and tipping of the pitcher. The top portion is formed at its upper front corner with a frontwardly and upwardly facing opening, through which the front and upper corner of an unopened bag of milk or other liquid which is placed in the pitcher may protrude, when the top is placed on the pitcher. The opening is at least partially covered by a cutter head which has a cutting edge, and the structure is such that the cutter head and cutting edge are moveable upwardly and downwardly in the opening. By that means, any portion of the flexible plastic bag which protrudes through the opening may be cut by the cutting edge when it is moved downwardly past and over that protruding portion of the flexible plastic bag.

The cutter head, moreover, co-operates with a pair of curved and rockable arms, which have a pair of inwardly directed opposed closer faces. The closer faces are curved away from each other at least in the upper portions of each, and are mounted in such a way as to be in close proximity to each other over a substantial portion of the length of each closer face when the cutter head is moved to the lower end of the frontwardly and upwardly facing opening in the top. The structure of the closer faces, therefore, is such that when the cutter head is moved downwardly to the lower end of the opening, the material of the bag below the cut corner is captured between the opposed closer faces on the rockable arms, and thereby the opening is relatively well closed.

Indeed, where each of the opposed closer faces is formed with a plurality of teeth which mesh and co-operate together with the teeth on the other of the opposed closer faces, and the cutter head is moved to the bottom of the opening so as to bring the lower portions of the closer faces into close proximity with each other, the meshing of the teeth in the opposed closer faces over the bag material will be such as to substantially seal the open corner of the bag. By "sealing" the open corner of the bag, what is meant is that inadvertent sloshing of the pitcher and spilling of the milk from the bag may be substantially precluded; and the bag is sufficiently sealed so as to at least retard if not substantially preclude the likelihood of the milk absorbing refrigerator odors or otherwise spoiling.

BRIEF DESCRIPTION OF THE DRAWINGS

The invention will now be described in greater detail, in association with the accompanying figures of drawings, in which.

DESCRIPTION OF THE PREFERRED EMBODIMENTS

Figure 1:
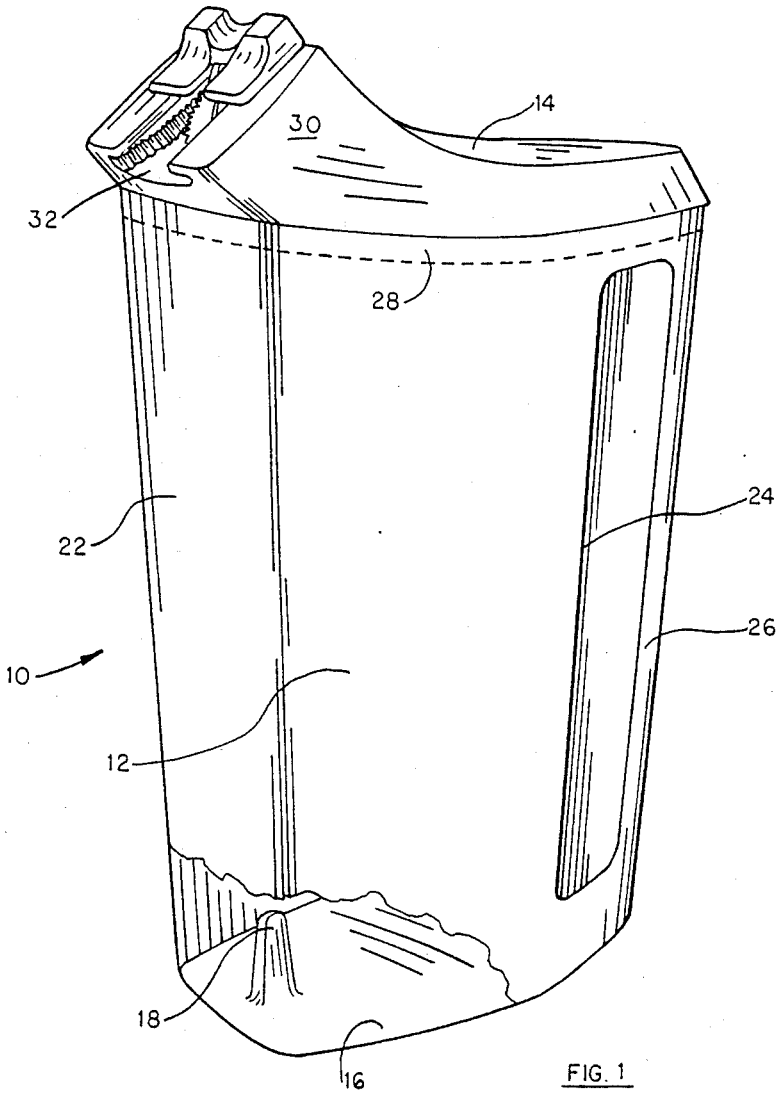
FIG. 1 is general perspective view, partially broken away near the bottom thereof, of a container according to the present invention, and with the top assembled to the bottom portion thereof.

The pitcher structure 10 of the present invention generally comprises a pitcher like bottom portion 12 and a top or cover portion 14. Each of the bottom portion 12 and the top portion 14 is substantially rigid, and may conveniently be moulded using injection moulding techniques from suitable plastic such as polyethylene, polypropolyene, co-polymers thereof, acrylics, and the like. Obviously, the bottom portion 12 is moulded so as to have height, width and front-to-back dimensions which approximate those of a flexible plastic bag of liquid to be placed in the pitcher. Thus, the volume of the bottom portion is approximately that of the volume of an unopened flexible bag of liquid intended to be placed therein.

In a preferred embodiment, although not necessarily, the bottom 16 of the bottom portion 12 of the pitcher is formed with an upwardly directed post or protrusion 18, substantially centrally located and slightly rearwardly positioned from the front face of the pitcher. If a flexible, form-filled bag of milk is placed into the bottom portion 12 of the pitcher, the protrusion 18 in the bottom of the pitcher will force the front corner of the bag upwardly and forwardly. The advantages of that feature are discussed hereafter.

The bottom portion of the pitcher structure of the present invention is conveniently moulded having a front face 22 and a back face 24; and conveniently a handle 26 is moulded and associated with the back face 24 in such a manner that the pitcher structure may be lifted, carried, and tipped, using the handle 26.

The top portion 14 is adapted to fit in a co-operating manner with the pitcher like bottom portion 12, so that the top portion 14 provides a cover for the pitcher structure of the present invention. Generally, the top portion 14 may be fitted to the bottom portion 12 by a downwardly depending skirt which is dimensioned so as to snuggly fit within the inner surfaces of the bottom portion 12 near the top edges thereof, as shown by dotted lines at 28 in FIG. 1.

The top portion, or cover, 14 is formed at its upper front corner 30 with a frontwardly and upwardly facing opening 32. The opening is defined, at least at its sides, by shoulders 34. The pitcher structure of the present invention is so dimensioned that when a flexible plastic bag of milk or other potable liquid is placed in the bottom portion 12, and the top portion 14 is assembled thereto, the front upper corner of the bag will protrude through the opening 32 in the manner shown at 36 in FIG. 6. [Needless to say, there may be instances where a pitcher structure of the present invention may have the wrong dimensions; if, for example, it is dimensioned for an Imperial quart bag, it will be too big for a 1.33 liter bag or a 1.5 quart bag. On the other hand, the pitcher structure of the present invention is so formed and designed for production in relatively low cost plastics materials such that, if the owner moves from a home in an area having, say, Imperial quart bags of milk to a home in another area having, say, 1.33 liter bags or 1.5 U.S. quart bags, the cost of replacing the pitcher will be quite insignificant.]

Figure 6:
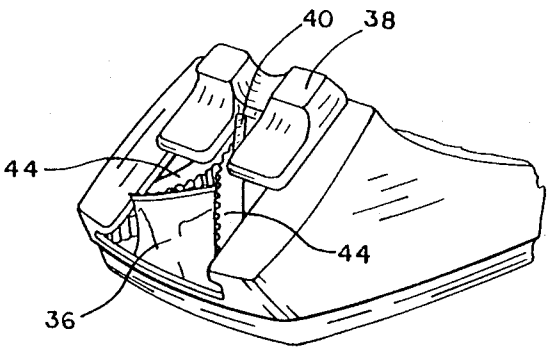
FIG. 6 is a view similar to FIG. 2 but showing the front upper corner of a plastic bag protruding through the opening.

The protrusion of the front upper corner of the bag through opening 32, as shown at 36 in FIG. 6, as well as the pouring characteristics of the pitcher, are enhanced by the presence of the upwardly directed post 18 in the bottom surface of the bottom portion 14. When a full, unopened bag of milk is placed in the pitcher, such that the bottom end near the bottom front corner contacts the post 18, the shape of the bag is forced to become more or less a parallelogram, in such a manner that the front face or leading edge of the bag is rearwardly and upwardly directed. Then, the front upper corner of the bag is pulled forwardly simply by grasping it between the fingers, and placed so that the front upper corner will protrude through the opening 32 when the cover 14 is in place. The front face of the bag is then slightly curved or bowed, but that "distortion" in the flexible filled bag results in excellent pouring characteristics after the front upper corner of the bag has been removed, no matter whether the bag is still fully filled, or at any level to being empty. It also, of course, permits or accomodates a broad range of heights of form-filled bags to be placed in the pitcher.

The opening 32 is at least partially covered by a cutter head 38. The cutter head 38 is mounted in the opening 32 in such a manner as to be moveable upwardly and downwardly therein, as discussed in greater detail hereafter. Moreover, the cutter head is provided with a cutting edge 40—which is conveniently a sharpened piece of cutting steel that is either moulded into the cutting head 38 or captured in the cutting head 38 as it is assembled to the top portion 14 in the opening 32. In any event, the cutting edge 40 is firmly retained in the cutter head 38, and will function to cut the front upper corner 36 of a flexible plastic bag when it first encounters the film material of the bag.

The cutter head is associated with, and co-operates with a pair of curved and rockable arms 44 which are mounted in the opening 32. Each of the rocker arms 44 has an inwardly directed closer face 46; so that, with the pair of rocker arms 44, there is a pair of opposed closer faces 46.

Figure 5:
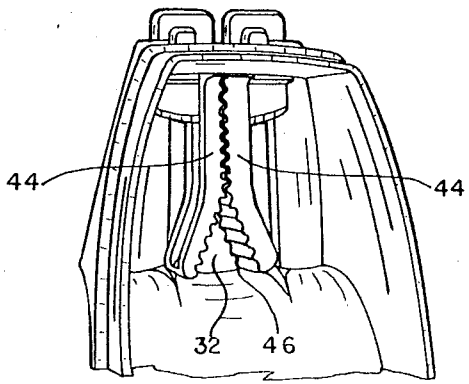
FIG. 5 is a view of the underside of FIG. 3.
Figure 3:
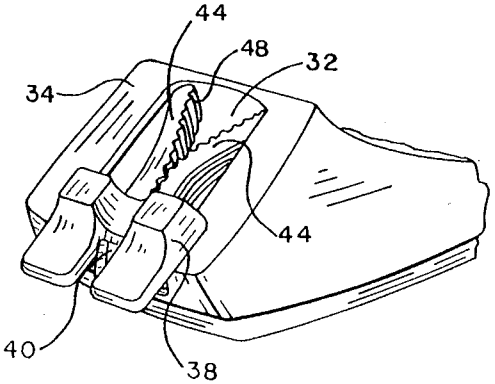
FIG. 3 is a view similar to FIG. 2 with the cutter head in the lower, closed position.
Figure 7:
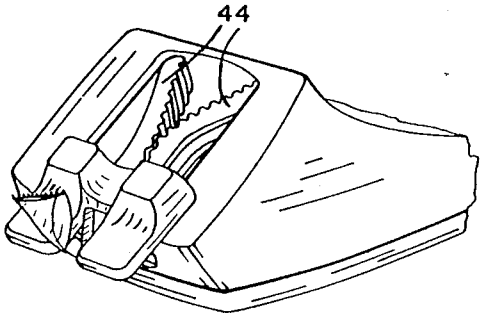
FIG. 7 is a view similar to FIG. 3 but showing the corner of the plastic bag having been removed.

Each of the rocker arms 44 is curved or otherwise profiled in such a manner that, when the cutter head 38 with which they are mounted is moved to the lower end of the opening 32, the closer faces 46 are in close proximity to each other over a substantial portion of the length of each closer face. This is particularly well illustrated in FIGS. 3, 5, and 7. Moreover, the profile of each of the rocker arms 44 is such that the upper portions of each of the closer faces 46 are curved away from each other, also as shown in FIGS. 3, 5, and 7.

When a closed, uncut, flexible plastic bag is first placed in the bottom portion 12 of the pitcher of the present invention, and the top or cover 14 is assembled to the bottom, as previously mentioned the upper front corner 36 of the bag will protrude or be positioned so as to protrude through the opening 32. Of course, the cutter head will be placed in its upper position prior to assembly of the top or cover 14 to the bottom 12. Then, as the cutter head 38 is moved downwardly in the opening 32, the film material of the plastic bag is captured between the closer faces 46, so that in the immediate area of the flexible plastic bag below the corner 36, the film material is substantially firmly and immovably held in position. Therefore, since the cutting edge 40 is mounted behind or somewhat higher than the front face of the cutter head 38, the downward motion of the cutter head 38 and the cutting edge 40 is across a portion of the film of the flexible bag that is firmly being held in place by the opposed closer face 46, so that the cutting action against the film is sure and positive.

In the preferred embodiment, the closer faces 46 are formed with a plurality of teeth 48, and the rocker arms 44 are so mounted that the teeth mesh with each other and co-operate with the teeth on the other of the opposed closer faces when contiguous portions of those opposed closer faces are brought into contact one with the other. These teeth 48 therefore function to more securely or effectively grip the film material of the plastic bag below the corner 36. Therefore, not only can a positive removal of the corner be effected by sliding the cutter head downwardly in the opening 32 when the bag is first placed in the pitcher, thereafter whenever the cutter head 38 is moved downwardly in the opening 32, the film material of the bag is captured between the rocker arms and thereby the bag is closed and relatively well sealed.

Figure 4:
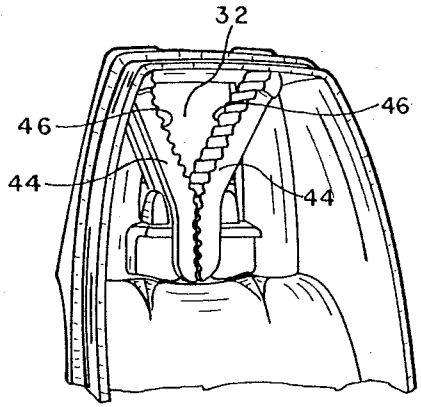
FIG. 4 is a view of the underside of FIG. 2.
Figure 2:
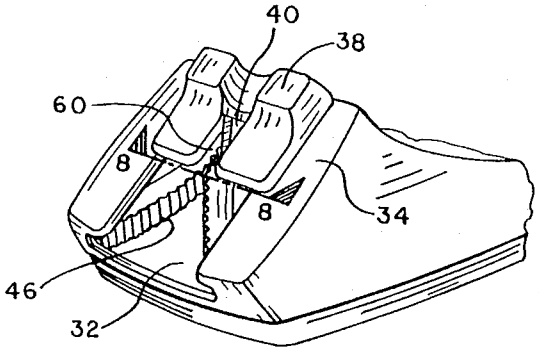
FIG. 2 is a detailed view of the front upper portion of the top, with the cutter head in its upper, open position.

It is clear that, in order to dispense milk from the bag using the pitcher, the cutter head 38 is moved to the top of the opening 32 as shown in FIGS. 2 and 4, and the dispensing action will cause the film of the bag in the vicinity of the cut corner through which the milk will be dispensed to remain in place within the defined opening 32 between the closer faces 46.

Figure 8:
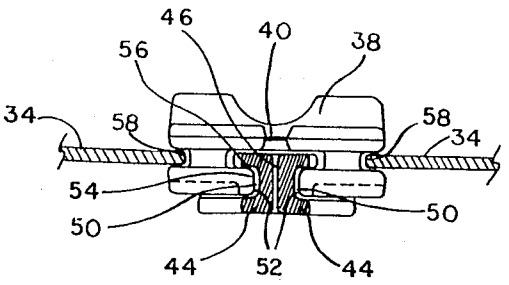
FIG. 8 is a cross sectional view taken along the line 8—8 in FIG. 2.

The rocker arms 44 are generally mounted in the opening 32 with the cutter head 38 in the manner illustrated in FIG. 8. There, it is shown that there is a pair of opposing faces 50 which act against a pair of back faces 52 in the rocker arms. The back faces 52 are, of course, opposite to the opposed closer faces 46. So as to effect retention of the rocker arms 44 within the cutter head 38, obviously, there should be a co-operating channel and ridge between each of the opposing faces 50 in the cutter head and the back faces 52 in the rocker arm. For convenience, and as shown in FIG. 8, the channel 54 may be formed in each of the back faces 52, and is captured by a ridge 56 in the opposing faces 50 in the lower portion of the cutter head 38.

Conveniently, the opening 32 which is formed in the cover portion 14 is substantially rectangular, so as to accommodate an easy upward and downward sliding motion of the cutter head 38. Moreover, the cutter head itself may be conveniently retained in the opening 32 by a pair of channels 58 formed in the outer side edges of the cutter head, each of the channels 58 being accommodated by and capturing one of the opposed side edges of the opening 32 along the shoulders 34 thereof.

As noted, the cutting edge 40 is mounted in the cutter head 38, and it is conveniently placed diagonally across a slit 60 formed from the lower edge of the cutter head 38 backwardly therein, to a distance less than the length of the cutter head 38 thereby precluding the possibility of the user cutting his or her fingers.

There has been described a pitcher for liquid such as milk or the like, in which a flexible bag of milk can be placed. Once the bag is placed in the pitcher, and the top is assembled thereto, the front upper corner of the bag may be cut therefrom so as to open the bag, and thereby to permit dispensing of the milk or other potable liquid from within the bag. Once the front upper corner of the bag has been cut, it may be closed and captured in a substantially sealed condition by a pair of opposed closer faces on rocker arms mounted within the opening through which the front upper corner first protruded; and the bag may be opened for further dispensing of milk or other potable liquid therefrom simply by moving the cutter head upwardly from within the opening and thereby releasing the film from between the opposed closer faces on the rocker arms.

The design of the cutter head 38 is such that it is replaceable. This is important if the cutting edge 40 becomes dull, which it might do over a period of several years. The cutter head 38 with cutting edge 40 may be marketed as a replacement part, with or without the rocker arms 44.

The dimensions of the post 18 can be varied by relatively simple changes to the moulds in which the pitcher—and especially, the bottom portion 12—are moulded. Thus, the post 18 can be varied in height so as to specifically serve certain markets where the bag size is consistant but different from other markets. Such examples may be the United States market, where the bag capacity 1.5 U.S. quarts, and the Canadian market where the bag capacity is 1.33 liters. As noted above, the pitcher will accomodate both bag sizes, and accomodate dimensional tolerances for both bag sizes, but it may be convenient to specifically relate the pitcher to one or the other market where a consistant protrusion of the front corner of the bag through the opening 32 may be expected by the user. Moreover, the protrusion or post 18 can be replaced by a sloped bottom surface over a major portion of the bottom of the pitcher, where the sloped bottom surface slopes downwardly and rearwardly from a position slightly rearwardly of the front face of the pitcher.

Several alternative structures have been discussed, and obviously the specific details of assembly and profile may differ without departing from the spirit and scope of the appended claims.

I claim:

1. A pitcher for liquids such as milk enclosed in a flexible plastic bag, where such a bag may be placed in said pitcher for the purposes of storage and of dispensing liquid from the bag by tipping said pitcher and a bag therewithin; where said pitcher comprises:

a substantially rigid, pitcher-like bottom portion having height, width, and front to back dimensions approximating those of a flexible plastic bag of liquid to be placed in said pitcher, so that the volume of said bottom portion is approximately that of the volume of an unopened flexible bag of liquid intended to be placed therein;

and a substantially rigid top portion adapted to fit in a substantially co-operating manner with said pitcher-like bottom portion, so as to provide a cover therefor;

where said top and bottom portions each have a front face and a back face, there being a handle associated with the back face of said bottom portion to facilitate lifting, carrying, and tipping of said pitcher;

and where said top portion is formed at its front upper corner with a frontwardly and upwardly facing opening through which the front and upper corner of an unopened bag placed in said pitcher may protrude;

said opening being at least partially covered by a cutter head having a cutting edge, where said cutter head and cutting edge are moveable upwardly and downwardly in said opening so as to cut any portion of a flexible plastic bag protruding through said opening;

and where said cutter head co-operates with a pair of curved and rockable arms which have inwardly directed, opposed closer faces that are curved away from each other at least in the upper portions of each, and which are mounted so as to be in close proximity to each other over a substantial portion of the length of each closer face when said cutter head is moved to the lower end of said opening;

thereby so as to removably cut the corner of a flexible plastic bag when first placed in said pitcher upon movement of said cutter head and cutting edge downwardly in said opening; and thereafter so as to substantially close the cut corner of the bag when said cutter head is at the lower end of said opening, by capturing the material of the bag below the cut corner and between said opposed closer faces.

2. The pitcher of claim 1, where each of said opposed closer faces is formed with a plurality of teeth which mesh and co-operate with the teeth on the other of said opposed closer faces, so as to more effectively close the cut corner of the bag.

3. The pitcher of claim 2, where said arms are mounted in said opening with said cutter head, and are retained in said cutter head by a pair of opposing faces in said cutter head acting against a pair of back faces opposite to said opposed closer faces, one in each of said arms; there being a channel formed in one of each of said opposing faces and said back faces, and a ridge capturable by and co-operating with said channel in the other of each of said opposing faces and said back faces.

4. The pitcher of claim 3, where said opening is substantially rectangular, and said cutter head is retained in a moveable manner in said opening by a pair of channels formed in the outer side edges of said cutter head, each of which accommodates one of the opposed side edges of said opening.

5. The pitcher of claim 4, where said cutting edge is mounted in said cutter head by being placed diagonally across a slit formed from the lower edge of said cutter head backwardly therein to a distance less than the length of said cutter head.

6. The pitcher of claim 1, where the bottom surface of said bottom portion has an upwardly directed post formed therein near the front face thereof.

7. The pitcher of claim 1, where the bottom surface of said bottom portion is sloped upwardly and forwardly at least in a substantial portion thereof.

* * * * *